United States Patent [19]

Calleance

[11] 4,187,569

[45] Feb. 12, 1980

[54] WATER MATTRESS CONSTRUCTION

[76] Inventor: Dave Calleance, 1945 23rd Ave., San Francisco, Calif. 94116

[21] Appl. No.: 883,523

[22] Filed: Mar. 6, 1978

Related U.S. Application Data

[63] Continuation-in-part of Ser. No. 761,499, Jan. 21, 1977, Pat. No. 4,080,676.

[51] Int. Cl.[2] ..... A47C 27/08; A47C 17/14

[52] U.S. Cl. ..... 5/451; 5/452

[58] Field of Search ..... 5/58, 202, 329, 345, 5/365–371

[56] References Cited

U.S. PATENT DOCUMENTS

| | | | |
|---|---|---|---|
| 3,732,585 | 5/1973 | Krehbiel | 5/451 |
| 3,918,110 | 11/1975 | Cantillo et al. | 5/451 |
| 3,994,033 | 11/1976 | Bendell | 5/58 |
| 4,006,501 | 2/1977 | Phillips | 5/451 |
| 4,080,676 | 3/1978 | Calleance | 5/451 |

*Primary Examiner*—Casmir A. Nunberg

[57] ABSTRACT

A water mattress construction which includes an interior perimetrical air chamber comprises three similar web portions of polyvinyl material or the like. The mattress is formed by first securing an air valve through the top sheet near the edge thereof. A first seam, which is spaced inwardly from the perimeter of the sheets, is then made to join the upper and medial web portions. A water valve is then secured through the upper and medial web portions, and is secured within the confines of the first seam. A second, perimetrical seam is then made to join the outer edges of all three web portions. The chamber defined by the upper and medial web portions and the two seams is filled with air, and the chamber defined by the medial and lower web portions is filled with water. Further seams may be made to join the upper and medial web portions forming medial chambers extending longitudinally in the mattress.

4 Claims, 14 Drawing Figures

WATER MATTRESS CONSTRUCTION

This application is a continuation-in-part of application ser. No. 761,499, filed Jan. 21, 1977, now U.S. Pat. No. 4,080,676, issued on Mar. 28, 1978.

BACKGROUND OF THE INVENTION

Although the water mattress has been known for more than forty years, it has only recently gained wide acclaim and popularity. The major attractions of the water mattress are its bouyant comfort, its therapeutic value for those suffering from back ailments, and the pleasure of sleeping on a heated mattress.

Detractors of the water mattress have criticized it for its other well-known characteristics. For example, wave motion within the water that fills the mattress is only lightly damped, and may continue for some period of time. Although many people find this wave action enjoyable, others find that it is not conducive to sound sleep. Furthermore, this wave action may have a resonant frequency which is a function of the size of the mattress, the volume of water filling the mattress, and the load supported by the mattress. Many individuals have found this resonant frequency phenomena not conducive to sleep or other bedroom pursuits.

Furthermore, although the water mattress may be unexcelled in providing uniform support to the human body, this support is only available in the medial portions of the water mattress. Any weight which is applied to the outer portions of the water mattress will merely displace water towards the center of the mattress, causing the outer portion to sag or collapse. Thus, a sleeping individual may easily roll into the frame which supports the edge of the mattress. Likewise, it is difficult, if not impossible, to sit on the edge of a water mattress, even when it is supported within a rigid framework.

The prior art is replete with methods and devices for overcoming the disadvantages of the water mattress. For example, partitions have been placed within the water mattress to dampen the wave action of the water. Also, water mattresses have been filled with gel preparations which increase the viscosity of the water, and reduce the wave propagation therein.

One effective modification of the standard water mattress has been the introduction of air chambers within the water mattress. These air chambers are used to increase the support which is provided by the mattress at the extremities thereof, and also to reduce or eliminate wave propagation and persistance within the mattress. Unfortunately, an air chamber augmented water mattress is much more difficult to manufacture, due to the many extra parts which must be assembled, and the great increase in the number of welds which must be made within the mattress. The construction techniques thus become arduous and time consuming, and the cost to the consumer is quite high.

Also, the air chambers used in state of the art water mattresses are generally disposed about the perimeter of the mattress. Thus, the added damping, rigidity, and edge support is uniform throughout the mattress. This uniformity may be undesirable for a pair of sleepers sharing a mattress, is their requirements for wave damping or mattress softness differ.

Patents which exemplify the state of the prior art include: U.S. Pat. Nos. 3,766,579; 3,778,852 and 3,864,768.

SUMMARY OF THE INVENTION

The present invention generally comprises a water mattress construction and method of construction therefor, which provides a simplified, air chamber augmented water mattress. It includes three substantially identical web sheets of polyvinyl material or the like which are assembled according to the method of the present invention. The air chamber is disposed about the upper perimetrical portion of the water mattress, where it provides support for an individual sitting on the edge of the bed as well as reducing wave phenomena known in the prior art.

The method of the present invention commences with the placement of the three web sheets in a vertically stacked disposition. A pair of valves are installed in the upper web sheet, in a location adjacent to the edge thereof. A continuous, endless inner seam, which is spaced inwardly from the edges of the web sheets, is then effected to join the upper web sheet to the medial web sheet. Further inner seams are made to define longitudinal air chambers disposed medially in the mattress. A water valve is then installed through the upper and medial web sheets, and is disposed within the confines of the inner seam. Next, an edge weld is effected to join all of the web sheets in a continuous sealed fashion.

In the present invention, the water chamber is defined by the medial and lower web sheets, extending the width and length of the mattress. Access to the water chamber is available through the water valve, which extends through the upper and medial web sheets. The air chambers are defined by the inner seams and the outer seam, and the upper and medial web sheets. The air chambers extend in adjacent rectangles about the periphery of the water mattress, and are generally disposed above a lateral midline thereof. Access to the air chambers is available through the air valves which extend through the upper web sheet.

A BRIEF SUMMARY OF THE DRAWINGS

DESCRIPTION OF THE PREFERRED EMBODIMENT

The present invention generally comprises a unique water mattress construction. and a method for fabricating the water mattress. The method of the present invention comprises a series of steps which are shown consecutively in FIGS. 1 through 9 of the accompanying drawings.

Figure 1:
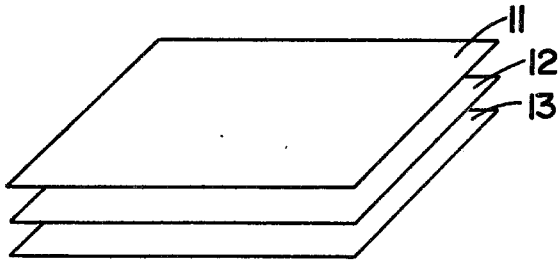
FIG. 1 is a perspective view of the three web sheets of the present invention during the initial stage of construction.
Figure 2:
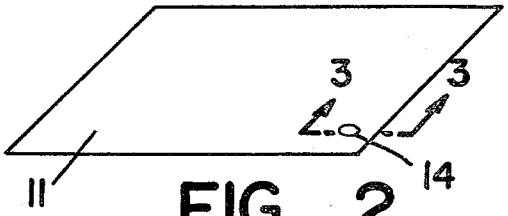
FIG. 2 is a perspective view of the top web sheet, shown with the air valve installed.
Figure 3:
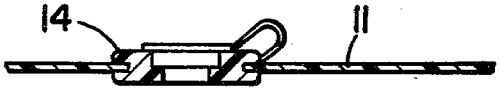
FIG. 3 is a cross-sectional detailed view taken along line 3—3 of FIG. 2.

As shown in FIG. 1, the method of the present invention commences with the provision of three web portions 11, 12, and 13, which are formed of polyvinyl material or the like. These web portions are identical in size and configuration, and are arranged in vertically stacked relationship. As shown in FIGS. 2 and 3, an air valve 14 is installed through the web portion 11, adjacent to one edge thereof. The air valve 14 may comprise any form of stopper valve, or any similar valve construction known in the prior art. In the preferred embodiment, the valve is installed at a distance of two to thirteen inches from the outer edge of the web portion 11.

Figure 4:
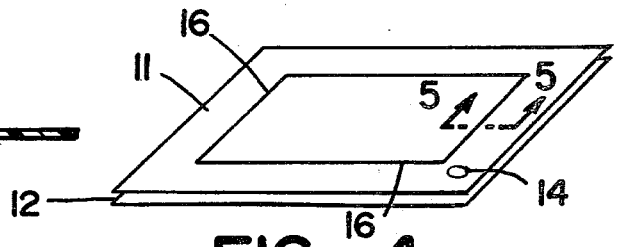
FIG. 4 is a perspective view showing the inner seam joining the top and medial web sheets of the present invention.
Figure 5:
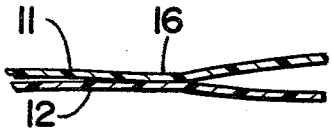
FIG. 5 is a cross-sectional detailed view taken along line 5—5 of FIG. 4.
Figure 6:
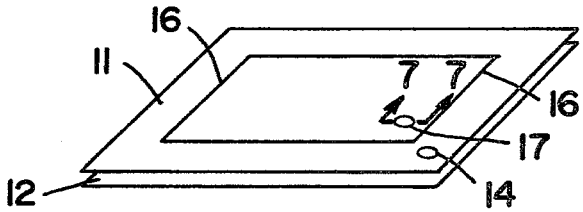
FIG. 6 is a perspective view of the top and medial web sheets, showing the water valve extending therethrough.
Figure 7:
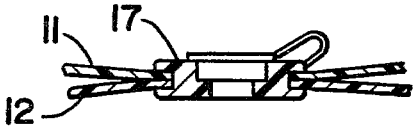
FIG. 7 is a cross-sectional detailed view taken along line 7—7 of FIG. 6.

The next step of the method of the present invention is shown in FIGS. 4 and 5. In this step, a continuous endless weld 16 is made to join the web portions 11 and 12 together. The weld 16 is a butt weld, as is clearly shown in FIG. 5. In the preferred embodiment, the weld 16 is disposed six to fifteen inches from the outer edges of the web portions. Next, a water valve 17 is installed through both web portions 11 and 12, within the confines of seam 16. The water valve shown in FIG. 7 is a conventional stopper valve, although any suitable valve known in the prior art may be employed.

Figure 8:
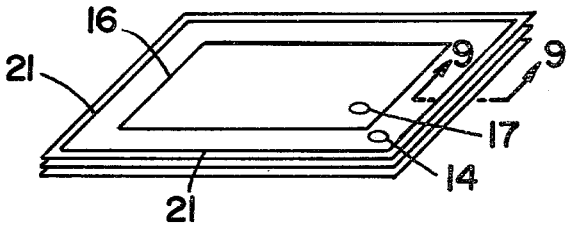
FIG. 8 is a perspective view of the three web sheets of the present invention, showing the edge weld joining all of the web sheets together.
Figure 9:
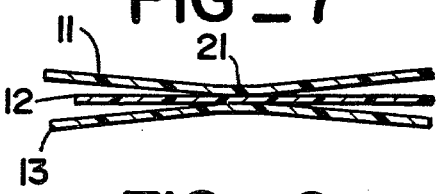
FIG. 9 is a cross-sectional detailed view taken along line 9—9 of FIG. 8.

The final step in the method of the present invention is the provision of an edge weld 21 which joins the web portions 11, 12, and 13 together. The weld 21 is continuous and endless, so that the web portions are joined in a permanent, sealed fashion. The weld 21 shown in FIGS. 8 and 9 is depicted as a butt weld. However, it may be appreciated by those skilled in the art that a lap weld could also be used to join the web portions together along the outer edge of the water mattress.

Figure 10:
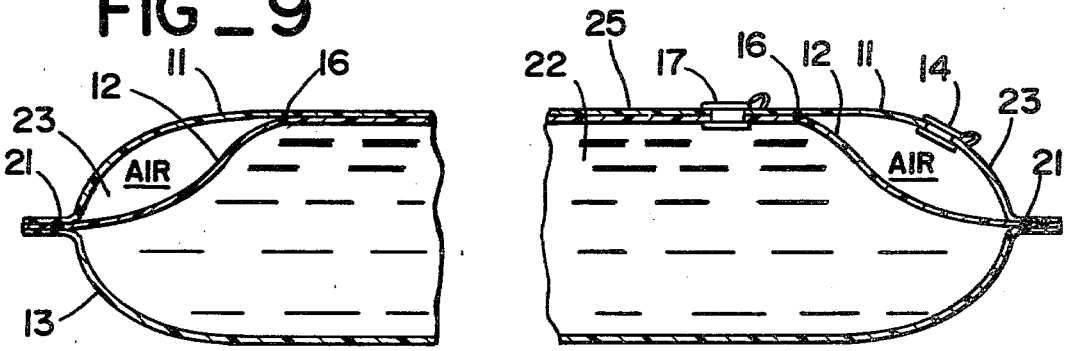
FIG. 10 is a cross-sectional elevation of the water mattress of the present invention.

The water mattress constructed according to the method of the present invention, shown in FIG. 10, includes a water chamber 22 and an air chamber 23. It should be noted that the water chamber 22 is defined by the web portions 12 and 13, and by the edge seam 21. The air chamber 23 is defined by the web portions 11 and 12, and the seams 16 and 21. The air chamber thus is disposed about the periphery of the water mattress 25, and may be inflated through valve 14. Access to the water chamber 22 is available through the water valve 17, which extends through both web portions 11 and 12. It should be noted that in the preferred embodiment, those parts of the web portions 11 and 12 which lie within the seam 16 are disposed in confronting, flush relationship, with no cavity or chamber defined therebetween. Thus, the portion of the water mattress within the seam 16, which supports most of the load on the water mattress and therefore receives most of the wear, is reinforced by virtue of the fact that it is supported by two thicknesses of polyvinyl material.

It is also a significant aspect of the present invention that the air chamber 23 provides substantial support for the edge portions of the mattress. That is, a load applied to the edge portion of the mattress will not cause the area supporting the load to sag or collapse. Rather, the air chamber will provide substantial support for the load, due to the rigidity caused by the air pressure therein, and also due to the buoyant support of the underlying water chamber 22. Thus, the water mattress of the present invention is capable of supporting an individual sitting on the edge of the mattress.

Figure 11:
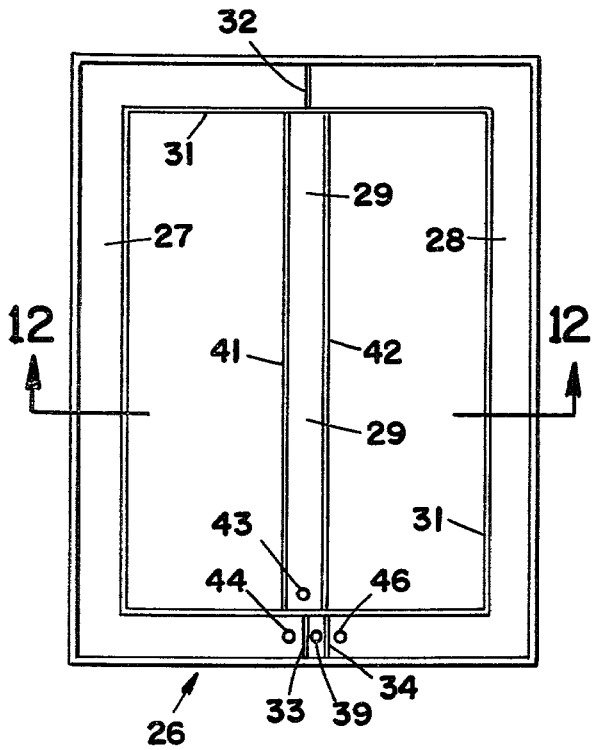
FIG. 11 is a plan view of a further embodiment of the present invention.
Figure 12:
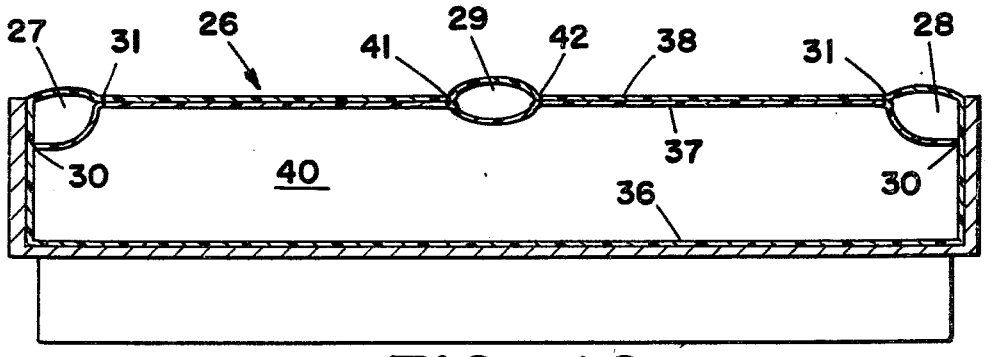
FIG. 12 is a cross-sectional view taken along line 12—12 of FIG. 11.

In another embodiment of the present invention, shown in FIGS. 11 and 12, the water mattress is provided with a medially disposed air chamber 29 extending longitudinally in the mattress, as well as the peripheral air chamber extending about the circumference of the water mattress. In this embodiment, there are two peripheral air chambers, 27 and 28, each disposed about half of the circumference of the water mattress.

As in the previous embodiment, this form of the water mattress comprises lower, medial, and upper web portions 36, 37, and 38, respectively. The three web portions are joined at their peripheries by a continuous edge seam 30. This seam may comprise a butt or lap seam, as desired. Spaced inwardly from the periphery of the web portion is a second continuous seam 31 which joins the upper and medial web portions. The seams 30 and 31 define the peripheral air chambers 27 and 28. A seam 32 joins web portions 37 and 38 and extends between the seams 30 and 31 to define the two peripheral air chambers at one pair of confronting ends thereof. A pair of seams 33 and 34 are situated in opposed relationship to the seam 32, and join the upper and medial web portions between the seams 30 and 31 to define the other pair of confronting ends of the air chambers. It should be noted that the seams 33 and 34 are closely spaced, with a water valve 39 disposed therebetween and extending through the upper and medial web portions to the water chamber 40 below.

A pair of parallel seams 41 and 42 extend longitudinally along a medial portion of the mattress, joining the inner seam 31 at both ends thereof. The seams 41 and 42 join medial and upper web portions 37 and 38, defining the medial air chamber 29. An air valve 43 extends through the upper web portion at one end of the air chamber 29, while air valves 44 and 46 extend through the upper web portion adjacent to the seams 33 and 34, to supply air to the peripheral air chambers 27 and 28, respectively.

The embodiment of FIGS. 11 and 12 provides individually selectable support and mattress stiffness to a pair of sleepers who choose to share the same water mattress 26. Each of the sleepers may repose in one of the areas between the medial air chamber 29 and the peripheral air chamber 27 or 28. The degree of inflation of the peripheral air chambers 27 and 28, together with the degree of inflation of the medial air chamber 29, provides a variable amount of wave damping, stiffness, and support to the sleeping areas directly adjacent to the separate, peripheral air chambers. Thus, a pair of sleepers having differing requirements for these water mattress characteristics may both repose in comfort.

Figure 13:
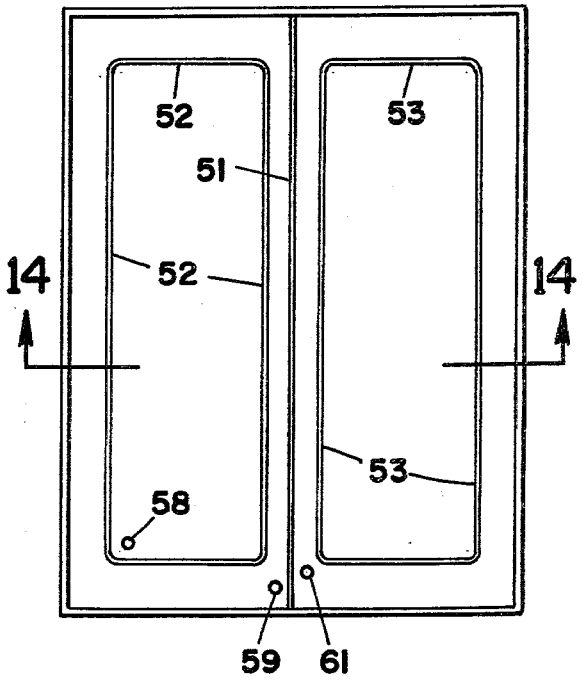
FIG. 13 is a plan view of another embodiment of the present invention.
Figure 14:
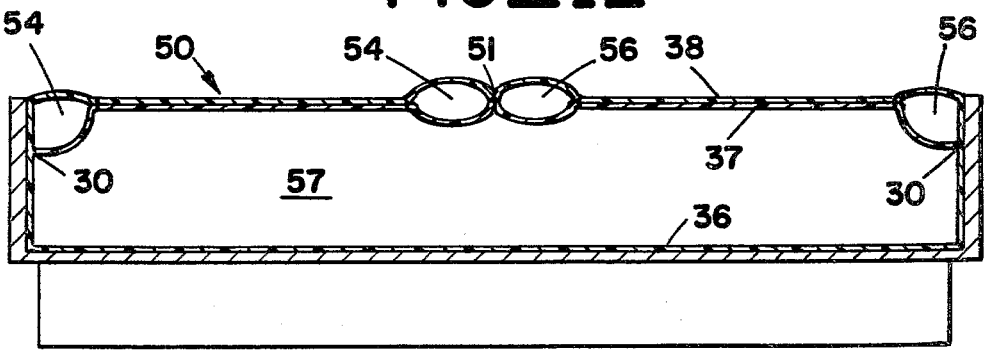
FIG. 14 is a cross-sectional view taken along line 14—14 of FIG. 13.

Another embodiment of the present invention, shown in FIGS. 13 and 14, also provides individually controlled and selected mattress characteristics for a pair of sleepers. This embodiment is comprised of lower, medial, and upper web portions 36, 37, and 38, which are joined at their peripheral edges by a continuous lap or butt seam 30. This water mattress 50 is provided with a seam 51 extending longitudinally the entire length of the mattress, joining the medial and upper web portions 37 and 38 and extending to the edge seam 30 at both ends thereof. The seam 51 divides the mattress 50 longitudinally into two sleeping areas of equal size.

Within each of the two individual sleeping areas, there is disposed a continuous seam 52 or 53 joining the medial and upper web portions 37 and 38. The seam 52 is spaced inwardly from the edge seam 30, and is also spaced a like amount from the longitudinal seam 51. The seam 53 is likewise spaced inwardly of the edge seam 30 and the longitudinal seam 51 in its respective half of the water mattress. Seams 52 and 53, together with the edge seams 30 and the longitudinal seam 51, define a pair of adjacent, rectangular air chambers 54 and 56. As in the previous embodiment, these air chambers are buoyantly supported by the water in the water cavity 57. Each air chamber 52 and 53 is provided with an air valve 59 and 61, respectively, to provide the desired amount of air pressure in each of the chambers. It should be noted that increasing air pressure in the air chambers of this embodiment, as well as in the previous embodiment, causes the air chamber increasingly to approach the configuration of a rigidly inflated tube. This action increases the stiffness of the portion of the mattress disposed within the air chamber, and also dampens the wave action of the mattress. Thus, it may be appreciated that a pair of individuals may individually select the stiffness and firmness of their portion of the water mattress, merely by adding or removing air through the valves 59 and 61. The water chamber 57 is filled through a common water valve 58 which extends through the medial and upper web portions 37 and 38 in a corner within the perimeter of one of the seams 52 or 53.

The preferred embodiments shown in the accompanying figures have been depicted as a rectangle having right angular corners. However, it may be appreciated that the method of the present invention may be employed to fabricate a water mattress having rounded corners, or non-linear edges. The construction of oval or round mattresses is also within the scope of the present invention.

I claim:

1. A unitary water mattress construction, comprising three web portions in vertically stacked relationship, said web portions being parallel and substantially similar in size and shape; a continuous edge weld joining the outer edges of said web portions in sealing fashion; a second, continuous weld spaced inwardly from said edge weld, joining the upper and medial ones of said web portions in sealing fashion; third and fourth welds extending between said edge weld and said second weld joining said upper and medial ones of said web portions in sealing fashion; said mattress including a water chamber defined by said medial and the lower web portions and said edge weld; and a pair of peripheral upper air chambers defined by said upper and medial web portions, said edge weld, said second weld, and said third and fourth welds and sealed from each other by said third and fourth welds; a water valve extending through said upper and medial web portions to said water chamber; and a pair of air valves extending through said upper web portion to said pair of peripheral upper air chambers.

2. The water mattress construction of claim 1, further including fifth and sixth welds, extending generally longitudinally and parallel within said second weld, joining said upper and medial web portions in sealing fashion and defining a medial upper air chamber extending longitudinally in said mattress.

3. A water mattress construction, comprising three web portions in vertically stacked relationship, said web portions being parallel and substantially similar in size and shape; a continuous edge weld joining the outer edges of said web portions in sealing fashion; a second weld extending longitudinally in said mattress and abutting said edge weld at both ends, joining the upper and medial ones of said web portions; third and fourth welds, each spaced inwardly from said edge weld and from said second weld, extending continuously and joining said upper and medial web portions in sealing fashion; said mattress including a water chamber defined by said medial and the lower web portions and said edge weld, and a pair of adjacent air chambers defined by said upper and medial web portions, said edge weld, said second weld, and said third and fourth welds; and means for selectively filling said water and air chambers.

4. The water mattress construction of claim 1 or 3 further including at least one further continuous weld joining said upper and medial web portions and forming an inflatable air pillow.

* * * * *